United States Patent [19]

Wilkenloh

[11] 4,117,260

[45] Sep. 26, 1978

[54] COAXIAL DROP WIRE

[75] Inventor: Frederic Nash Wilkenloh, Conover, N.C.

[73] Assignee: Comul Scope Company, Catawba, N.J.

[21] Appl. No.: 825,474

[22] Filed: Aug. 17, 1977

[51] Int. Cl.[2] ..... H01B 7/18; H01B 9/02

[52] U.S. Cl. ..... 174/106 R; 174/107

[58] Field of Search ..... 174/105 R, 107 R, 102 R, 174/106 R

[56] References Cited

U.S. PATENT DOCUMENTS

| | | | |
|---|---|---|---|
| 3,060,261 | 10/1962 | Stanley et al. | 174/106 R |
| 3,275,739 | 9/1966 | Eager | 174/102 R |
| 3,484,532 | 12/1969 | Anderson | 174/105 R |
| 3,681,515 | 8/1972 | Mildner | 174/105 R |
| 3,742,363 | 6/1973 | Carle | 174/102 R |
| 3,749,812 | 7/1973 | Reynold et al. | 174/107 |
| 3,927,247 | 12/1975 | Timmons | 174/107 |

*Primary Examiner*—J. V. Truhe
*Assistant Examiner*—John H. Bouchard

[57] ABSTRACT

Disclosed are several embodiments of Improved CATV (Coaxial Drop Wire), using either foil laminate or a metallic braid in combination with another foil laminate adhesively bonded to the drop wire core dielectric, the improvements being (a) the elimination of traverse (radial) cracks, commonly called "tiger striping," developing in the foil as a result of the foil wrinkling, and (b) the elimination of slot antenna effect. One embodiment employs two laminated tapes, one circumferentially surrounding the other and both circumferentially surrounding a core. One laminated tape is bonded to the core dielectric and the other is bonded to a jacket, surrounding the outer laminate tape. The other embodiment employs a metallic braid tape circumferentially surrounding a metal foil-plastic film-metal foil laminate tape adhesively bonded to the core dielectric. Added strength is imparted to the Drop Wire by means of a tape made from woven strands of glass, bonded to the innermost surface of the plastic jacket circumferentially surrounding the outer conductor (braid or foil laminate) of each embodiment.

13 Claims, 13 Drawing Figures

COAXIAL DROP WIRE

FIELD OF INVENTION

This invention relates to Community Antenna Television Drop Wire, more commonly called CATV Drop Wire and is characterized by a coaxial structure having either a matallic braid or plastic film-metallic foil laminate in combination with another plastic film metal foil laminate bonded to a dielectric circumferentially surrounding a center conductor. The metal foil closest to the center conductor acts as an outer conductor, the balance of the metal foil and/or braid, as the case may be, acts as a composite shield and outer conductor.

DESCRIPTION OF PRIOR ART

CATV Drop Wire is essentially a coaxial cable used to complete the circuit in a CATV system from the trunk cable to a subscribers television set. Usually drop wire is much smaller in size (diameter) than trunk cable and primarily is strung from a pole to a subscribers home; whereas, a CATV trunk cable normally is strung on poles and acts as the main distribution means for distribution of CATV signals throughout the system. Some systems are buried; thus, poles are not used. Coaxial Drop Wire is composed of a core (a center conductor member circumferentially surrounded by a cylindrical wall of dielectric material) with an outer conductor member coaxially superimposed over the dielectric. The dielectric can be a cylindrical wall of expanded or unexpanded polyolefin insulation surrounding the center conductor and is usually composed of some suitable plastic, e.g. polyethylene, polystyrene, polyproplene, and/or mixtures of same. The dielectric can be either in the expanded (foam) or unexpanded (solid) form. The center and outer conductor usually are made from some appropriate metal, e.g. copper or aluminum.

As recently as September, 1975, an article appeared in *TV Communications*, the professional journal of cable television, stating "The search for better CATV cable goes on, with the emphasis on improved shielding." The solution to this search is the focus of the instant invention.

It has been recognized, as evidenced by the above-identified article, that inadequate shielding in a CATV Drop Wire may cause radiation interference (CATV system signals leaking outside of the system), direct pick-up (introduction of non-CATV system signals into the CATV system), or both. Radiation interference normally can be the cause of a great deal of trouble to a CATV system and thus is undesirable. For example, if a non-system subscriber complains to the FCC that stray signals (radiation leakage from a CATV system) are causing interference on his television set, the FCC will investigate promptly and insist the problem be corrected immediately if the complaint is found to be valid.

Direct pick-up subscribers'strong local broadcasting channels) results in ghost on CATV sybscribers' sets and this lack of picture quality can cause loss of subscribers or extra service calls, both of which are costly.

Increasingly popular has become the use of drop wire in the CATV industry using braid coverage over a laminated tape composed of aluminum foil bonded to both surfaces of a Mylar or polypropylene type film. This popularity is primarily due to the low cost factor of the tape and theoretical achievement of one hundred percent shielding. However, shield effectiveness is affected significantly by the connector interface. An improperly attached connector, even with the best drop wire of the prior art, can create a cable condition resulting in signals radiating from the drop wire well above FCC Technical Standards, Part 76. The best way to maintain shielding integrity is to insert the connector bushing between the foil and the braid, see element 16 in FIGS. 6 and 11. A connector (see element 20, FIGS. 5 and 10) in a CATV system is that device used to connect the smaller diameter CATV Drop Wire to the larger diameter CATV trunk cable.

In prior art drop wire, it was not always possible, in all cases, to properly insert the connector bushing (element 16) between the foil and the braid because the cable wrinkled under the connector, i.e. pushed back during insertion of the bushing. Not only did this make the connection difficult but it also resulted in excessive radiation, which is a problem to be avoided for the reasons stated above.

Some prior investigations have attempted to solve the problems set forth above by a drop wire configuration employing what is called a bonded foil shield (a metal foil bonded to a plastic film, the film being coated with an adhesive, see FIG. 12.) in combination with a braid. Under the braid, not shown in FIG. 12, is the bonded foil shield and on the shield's innermost surface bonded thereto is a plastic film and on the plastic film, a heat activatable adhesive. This coated metal foil shield in the form of a tape is applied longitudinally (circumferentially surrounding the core) with a longitudinal overlap of approximately of a quarter of an inch, such as that is shown in the U.S. Pat. No. 3,315,025 to H. M. Tomlinson issued Apr. 18, 1967 and diagrammatically in FIG. 12. An overall plastic outer jacket is extruded over top of the foil and braid and the heat used to apply the plastic jacket activates the adhesive, causing it to bond permanently to the dielectric of the core. This example is sometimes referred to as the "bonded foil" solution. In the electrical sense, the innermost foil member acts as an outer conductor and the balance of the metal members act as a composite shield and outer conductor members.

The above-mentioned bonded foil solution is effective in solving the ¢push-back problem," but unfortunately introduces other functional problems. First, the flex life of the cable is reduced. This is of particular concern for outdoor type CATV Drop Wire, which are ordinarily subject to considerable flexing due to wind, plus alternate thermal expansion and contraction. When the core dielectric bends, the foil being bonded to the dielectric apparently is prevented from "giving." This gives rise to the foil wrinkling, on the inside arc of the bend. See element 14 of FIG. 4. Although this in and of itself presents no problems, the foil on the outside of the arc breaks, causing a multitude of transverse radial cracks in the foil shield. See element 13 of FIG. 4. This is called "tiger stripping" and is a problem of major concern. Even a minute crack, transverse or longitudinal, can result in severe signal radiation.

A second problem arises when the bonded foil solution is used. At the point of overlap of the bonded foil (see FIG. 12), there is no point where there is metal-to-metal contact. This lack of metal-to-metal contact results in a small longitudinal opening in the shield running the entire length of the cable and creates what is called a "slot antenna effect." The outer conductor braid circumferentially surrounding the bonded foil shield helps to reduce this effect; however, a shield gap still remains, which permits radiation to emit from the system even before "tiger stipping" develops.

It is to be understood throughout this specification that all metal and plastic members impart strength characteristics to the Drop Wire. The innermost metal member closest to the center conductor acts as the outer conductor in the coaxial cable scheme of signal transmission, with the remaining metal members performing as a composite shield and outer conductor.

Previous investigators have suggested the use of a "double-sided foil shield", i.e. a plastic film having metal foil bonded to its two major surfaces to solve the slot antenna effect. See element 7 of FIG. 13, the bonded composite of elements 8 (metal foil) and 9 (plastic film). At the longitudinal overlap, where the terminal portions of the double-sided foil shield overlay one another, there is a metal-to-metal (foil-to-foil) contact which eliminates the slot antenna effect. However, prior investigations have stopped there, and thus failed to recognize that by adhesively bonding the innermost metal foil surface of the metal-plastic-metal laminate circumferentially surrounding the drop wire core to the dielectric of the core, tiger striping can be eliminated. For example, Neil P. Gallagher, in the publication cited above, mentions the use of "double-sided foil shield" to solve the problem of slot antenna effect but goes on to describe that tiger striping is still observed. Furthermore, by adhesively bonding, as suggested above, the dielectric of the drop wire is protected from penetration of water that happens to penetrate the outer jacket.

SUMMARY OF THE INVENTION

CATV Drop Wire of the instant invention is free from the two major problems normally associated with this type of product; namely, (a) slot antenna effect and (b) tiger striping. Solution of these two problems is achieved by the use of at least one laminate composed of a plastic film, both major surfaces of which are bonded to a metal film. One surface of one of the metal films is adhesively bonded to the core dielectric circumferentially surrounding a center conductor. In one embodiment, a metal braid circumferentially surrounding the laminate tape is used as a composite outer conductor shield and strength member. Another embodiment employs no metallic braid, but two laminate tapes, both circumferentially surrounding a core, one metal surface of the innermost tape adhesively bonded to the core dielectric and a metal surface of the outermost laminate tape adhesively bonded to a jacket extruded over it. In both embodiments, an outer jacket is extruded over the outermost member of the drop wire structure, the metallic braid in one and a laminate tape in the other. Glass cloth in the form of a tape made from woven glass fibers or strands can be interposed between the innermost surface of the jacket and outermost surface of the first laminate or braid, as the case may be, and adhesively bonded to the jacket and laminate surface for added strength.

The major object of the present invention is to provide a novel CATV Drop Wire essentially free from problems of "tiger striping" and antenna slot effect.

Another object of the present invention is a provide a novel CATV Drop Wire having greatly improved strength characteristics and radiation shielding adapted for the easy insertion of connector bushings without deleterious affect to the shielding characteristics.

These and other objects are achieved by the use of at least one metal foil-plastic film-metal foil film laminate, one metal foil surface being bonded to the dielectric of a coaxial cable core, a cloth woven from glass strands bonded to the innermost surface of a plastic jacket circumferentially surrounding an outer conductor, and a metallic braid in one embodiment or a second laminate in another, both circumferentially surrounding the first mentioned laminate. The novel CATV Drop Wire is a structure adapted for the easy insertion of a connector bushing between the outer conductor (braid or laminate) and one metal foil surface of a laminate bonded to the core dielectric.

DESCRIPTION OF THE PREFERRED EMBODIMENTS

Apparatus and methods of manufacturing CATV Cable and Drop Wire are well known and form no part of the present invention. For example, the method, materials, and apparatus of making a drop wire cable core (center conductor circumferentially surrounded by an expanded polyolefin, sometimes referred to herein as a cylindrical wall or core dielectric) is shown in U.S. Pat. No. 3,968,463 to Boysen issued July 6, 1976. Furthermore, U.S. Pat. No. 3,315,025 to Tomlinson issued Apr. 18, 1967 also teaches the same broad concepts as Boysen and further discloses the additional concept of bonding a tape of metal foil to a core dielectric by means of an adhesive composed of a copolymer of ethylene and acrylic acid, the later being more fully disclosed in U.S. patent to Rugg et al U.S. Pat. No. 2,970,129 issued Jan. 31, 1961. Double metal foil laminates as contemplated by the present invention are disclosed in telephone cable environment in U.S. Pat. No.

3,233,036 to Jachimowicz issued Feb. 1, 1966. All of the disclosures of the above identified U.S. patents are incorporated herein by reference as if they were faithfully reproduced in this disclosure. The apparatus, materials, and methods of manufacture described in these prior art publications can be used to carry out the present invention.

FIRST EMBODIMENT

Figure 1:
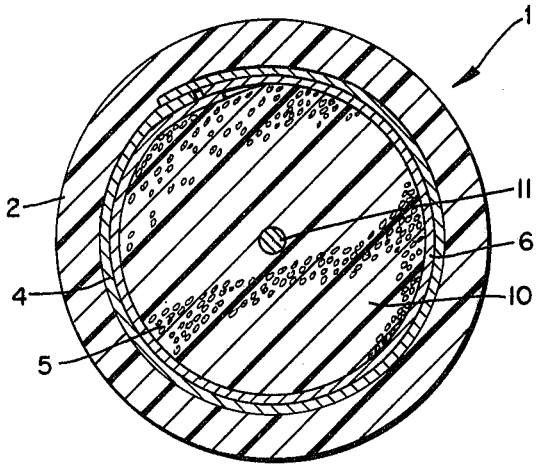
FIG. 1 is a semi-detailed cross section of the embodiment of CATV Drop Wire made in accordance with the present invention employing two metal foil laminates.

With reference to FIG. 1, element 1 shows in cross section the first embodiment of the CATV Drop Wire of the present invention. Outer plastic jacket 2 circumferentially surrounds laminate tapes 4 and 6, which in turn circumferentially surround the drop wire core, i.e. dielectric 10 and center conductor 11.

Figure 2:
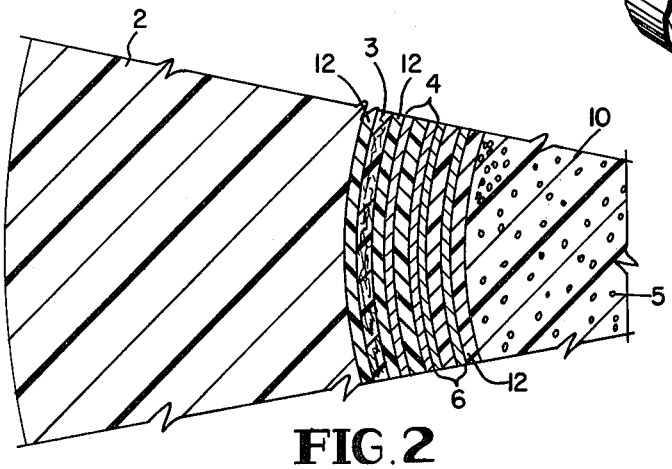
FIGS. 2 and 3 are greatly enlarged bilateral cross sections of the jacket, two metal foil laminates and core dielectric of FIG. 1.
Figure 3:
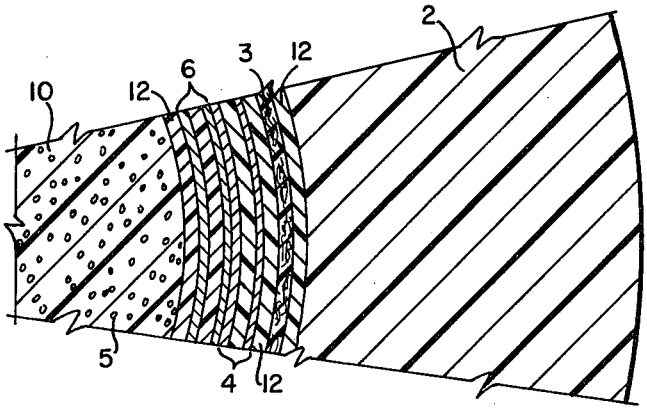

Referring to FIGS. 2 and 3, outer plastic jacket 2 surrounds and is adhesively bonded by adhesive 12 to the outermost surface of glass cloth tape 3. The glass cloth acts as a strength member and circumferentially surrounds and is adhesively bonded to the outermost surface of laminate 4 by adhesive 12. Laminate 4 circumferentially surrounds, but is not bonded to laminate 6, which circumferentially surrounds core dielectric 10. Both laminate 4 and 6 are the same as element 7 of FIG. 13. The innermost surface of laminate 6 is adhesively bonded to core dielectric 10 by adhesive 12. Center conductor 11 is circumferentially surrounded by a cylindrical wall of dielectric 10, comprising the drop wire core. Center conductor 11 can be made from any suitable metals such as copper or aluminum or alloys of same or it can be a copperwire clad with steel. The core dielectric or cylindrical wall 10 can be of an expanded or unexpanded plastic, e.g. a polyolefin (polypropylene or polyethylene). Dielectric 10 may be expanded, as shown in the drawings (note void 5) or it may be unexpanded (not shown). Adhesive bonding can be achieved as described above; namely, by heat activatable copolymer of ethylene and acrylic acid disclosed by Tomlinson and Rugg and is heat activatable by the heat employed to extrude jacket 2. Metal foils 8 of either aluminum or copper having a thickness between 0.005 inches 0.001 inches bonded to the major surfaces of a plastic film having a thickness between 0.005 and 0.0001 inches can be used to form laminate 7, i.e. laminates 4 and 6. Between 0.0035 and 0.0050 inches is a convenient thickness for jacket 2.

In this embodiment, the innermost metal foil of laminate 4 (the one closest to center conductor 11) acts as the outer conductor for the coaxial drop wire. The balance of the metal foils of laminates 4 and 6 perform the combined function of a shield and outer conductor. The glass cloth 3, if employed, acts as a strength member.

Figure 4:
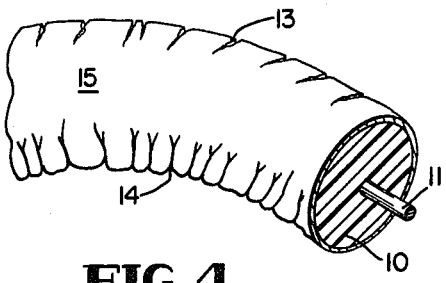
FIG. 4 is a representation of a prior art CATV Drop Wire showing tiger striping developed on the outer curve of a bend in a metal foil used as a shield.
Figure 5:
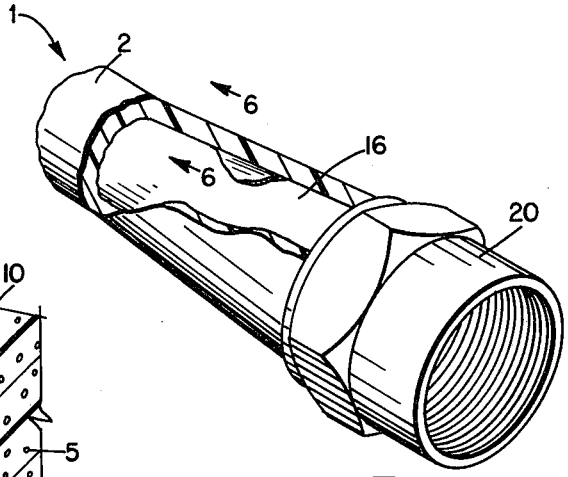
FIG. 5 is a diagrammatical view of a connector bushing inserted between two metal foil-plastic tape laminates of the embodiment shown in FIG. 1.
Figure 6:
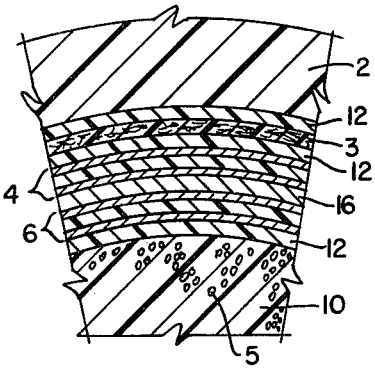
FIG. 6 is a cross sectional view along the lines 6—6 of FIG. 5.

It has been found that by bonding laminate 6 to core dielectric 10, there is created a drop wire that is easy to bend, as one would not expect, and a drop wire structure that effectively solves the tiger striping problem shown in FIG. 4, namely, the transverse (radial) cracks 13 in metal shield 15. Connector bushing 16, see FIG. 6, is inserted between laminate 4 and 6 and thus comes in contact with a metal surface of both in the fashion as shown. Bonding of laminate 6 to core dielectric 10 not only solves the tiger striping problem, but also prevents the laminate from wrinkling, by its being pushed backwards upon insertion of the bushing as it would have a tendency to do so absent such bonding. By bonding laminate 4 to glass cloth 3 with adhesive 12, it too is prevented from being pushed back when connector bushing 16 is inserted between laminate 4 and 6.

Figure 13:
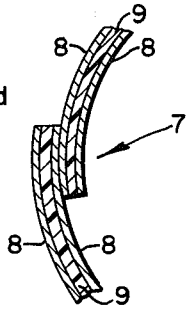
FIG. 13 is a fragmentary cross sectional view of the overlapping terminal portions of a prior art drop wire double-sided foil shield.

Laminates 4 and 6 have terminal portions that overlap (See FIG. 1) in the same fashion as the overlapping terminal portions of element 7 of FIG. 13. By thus doing, a metal-to-metal (foil-to-foil) contact is created thus solving the slot antenna effect problem.

SECOND EMBODIMENT

Figure 7:
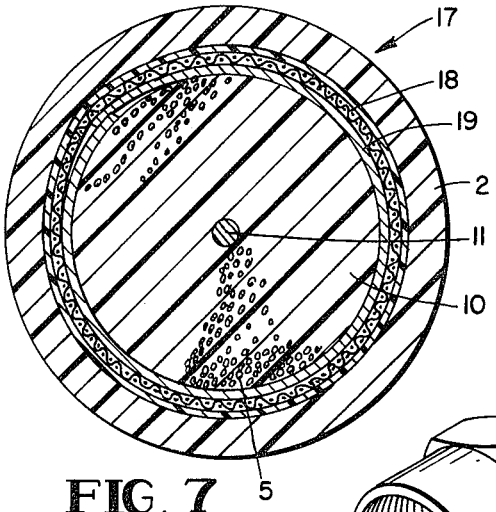
FIG. 7 is a semi-detailed cross section of the embodiment of CATV Drop Wire made in accordance with the present invention employing one metal foil laminate and one metallic braid.
Figure 10:
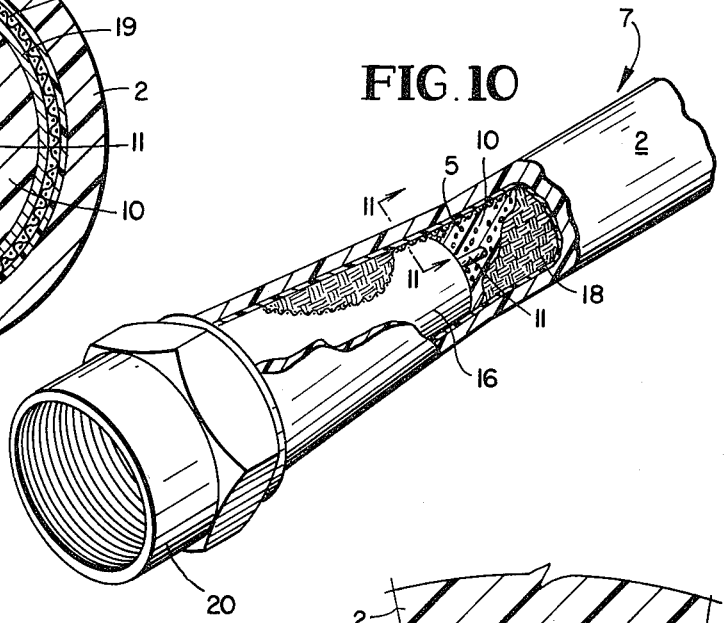
FIG. 10 is a diagrammatical view of a connector bushing inserted between the metal foil laminate and metallic braid of the embodiment shown in FIG. 7.

With reference to FIG. 7, element 17 shows in cross section the second embodiment of the CATV Drop Wire of the present invention. Outer plastic jacket 2 circumferentially surrounds laminate 19. Drop wire core, center conductor 11 and dielectric 10, is nested inside of and circumferentially surrounded by laminate 10.

Figure 8:
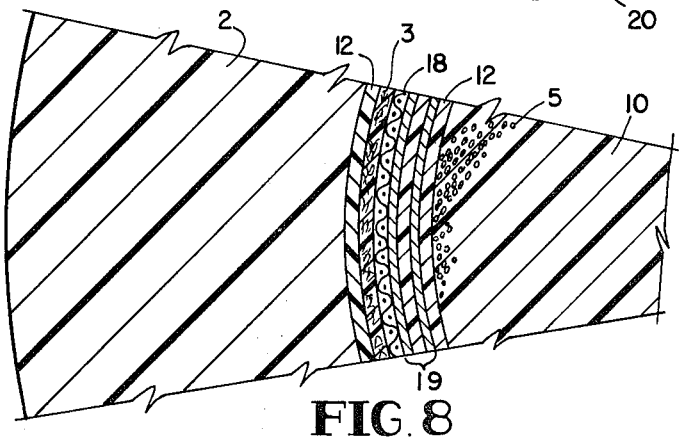
FIGS. 8 and 9 are greatly enlarged bilateral cross sections of the jacket, metal foil laminate, metallic braid and core dielectric of FIG. 7.
Figure 9:
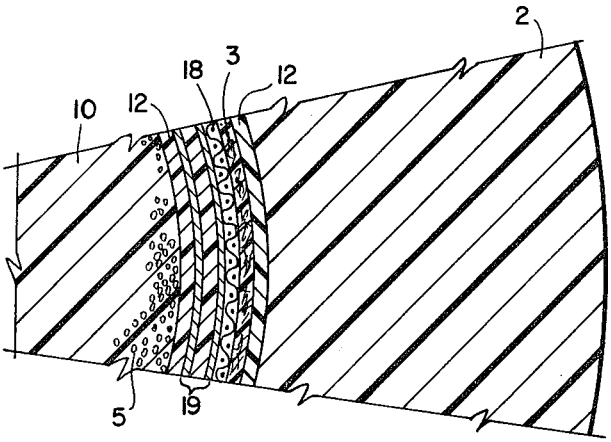

Referring to FIGS. 8 and 9, outer plastic jacket 2 surrounds and is bonded to glass cloth tape 3, made from woven glass strands. Metallic braid 18 (woven strands of metal) is nested inside of glass cloth tape 3 and circumferentially surrounds laminate 19, composed of a plastic film 9 with metal foils 8 bonded to both of its major surfaces, the same as shown as element 7 of FIG. 13. Laminate 19 circumferentially surrounds core dielectric 10. Both laminate 19 and metallic braid 18 have terminal portions that overlap one another. The overlapping portions of laminate 19 create a metal-to-metal (foil-to-foil) contact more clearly shown in FIG. 13, thereby avoiding any slot antenna effect. The innermost metal foil of laminate 19 acts as the outer conductor and the balance of the metal members of this laminate acting as a composite shield and outer conductor. Braid 18 acts as a composite strength member-shield outer conductor separated and insulated from inner conductor 11 by core dielectric 10 and laminate 19.

The drop wire core is composed of center conductor 11 made from any suitable metal such as copper clad steel, copper or aluminum and suitable alloys of the same circumferentially surrounded by dielectric 10, which is a cylindrical wall of expanded or unexpanded plastic, e.g. a polyolefin (polypropylene or polyethylene). Dielectric 10 may be expanded, as shown in the drawings (note element 5) or it may be unexpanded (not shown).

On the innermost surface of laminate tape 19 is disposed an adhesive 12 adapted to adhesively bond it to dielectric 10 of the cable core. An example of such adhesive is a copolymer of ethylene and acrylic acid disclosed by Tomlinson and Rugg and is heat activatable by the heat employed to extrude jacket 2. On the outermost surface of glass tape 3 is a coating of the above described adhesive copolymer 12 bonding it to jacket 2. Metallic braid 18 can be made of woven strands of suitable metal such as copper or aluminum, the metal strands having 300 to 500 picks (ends) per inch of width. Metal foils of either aluminum or copper having a thickness between 0.004 and 0.0001 inches bonded to the major surfaces of a plastic film having a thickness between 0.005 and 0.0001 inches can be used to form the laminate. Plastic jacket 2 can have a thickness between 0.0035 to 0.0050 inches.

Figure 11:
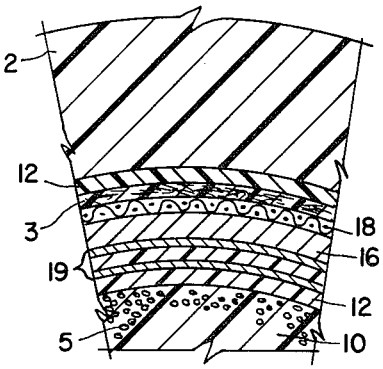
FIG. 11 is a cross sectional view along the line 11—11 of FIG. 10.
Figure 12:
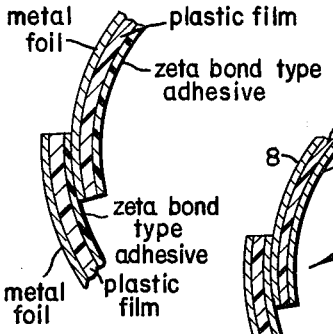
FIG. 12 is a fragmentary cross sectional view of the overlapping terminal portions of a prior art drop wire single foil shield, commonly referred to as the "bonded foil shield or tape solution."

It has been found that by bonding laminate 19 to core dielectric 10, there is created a drop wire structure that permits the easy bending of the drop wire, as one might not expect, but it also effectively solves the tiger striping problem, shown as element 13 in FIG. 4. Connector bushing 16 is inserted between braid 18 and laminate 19 in the fashion as shown in FIG. 11. The bonding of laminate 19 to core dielectric 10 not only solves the tiger striping problem, but also prevents the laminate from wrinkling by it being pushed back upon insertion of the bushing 16.

Both of the above described embodiments can be made using the materials, apparatus, and manufacturing methods described in the previously identified prior art. Briefly stated, the manufacturing process is as follows: (1) A drop wire core is created by extruding a dielectric (foamed or unfoamed) over a wire center conductor; (2) The core is then passed through a tape folding apparatus in a well known manner to apply the laminate and/or braid tapes as required by the construction of the particular embodiment under construction to form a composite; and finally (3) The composite is passed through the crosshead of an extruder where a plastic jacket is extruded over it simultaneously activating the heat activatable adhesive to bond the various members of the composite together in the manner disclosed.

Various modifications of the invention in addition to those shown and described herein will become apparent to those skilled in the art from the foregoing description and accompanying drawings. Such modifications are intended to fall within the scope of the appended claims.

What is claimed is:

1. A coaxial cable comprising:

(a) an inner metallic conductor;

(b) a cylindrical core of polyolefin insulation surrounding said conductor;

(c) a laminate tape composed of two metal foils adhesively bonded to opposite surfaces of a plastic film, said laminate tape circumferentially surrounding said cylindrical core, one surface of one of said metal foils being adhesively bonded to substantially the entire outermost surface of said cylindrical core;

(d) a metallic braid tape circumferentially surrounding said laminate tape, said braid tape lying in contact with the other of said metal foils but being unbonded thereto whereby the tubular portion of an electrical connector is insertable between said braid tape and said laminate tape; and, (e) a plastic jacket circumferentially surrounding said metallic braid.

2. A coaxial cable according to claim 1 wherein said one of said metal foils is bonded to the outer surface of said core by a thin layer of copolymer of ethylene and acrylic acid, said layer being interposed between the outer surface of the cylindrical core and said one of said metal foils.

3. A coaxial cable as in claim 1 wherein is interposed between said metallic braid tape and said plastic jacket, a cloth composed of woven strands of fiber glass, said cloth being adhesively bonded to the innermost surface of said plastic jacket.

4. A coaxial cable as in claim 3 wherein said woven glass cloth is bonded to said plastic jacket by a thin layer of copolymer of ethylene and acrylic acid, said layer being interposed between the outermost surface of said woven glass cloth and the innermost surface of said plastic jacket.

5. A coaxial cable comprising:

(a) an inner metallic conductor;

(b) a cylindrical core of polyolefin insulation surrounding said conductor;

(c) a first laminate tape composed of two metallic foils adhesively bonded to opposite surfaces of a plastic film, said laminate tape circumferentially surrounding said cylindrical core, one of said metal foils of said first laminate tape being adhesively bonded to substantially the entire outermost surface of said cylindrical core;

(d) a second laminate tape circumferentially surrounding said first laminate tape and composed of two metallic foils adhesively bonded to opposite surfaces of a plastic film, one of the metal foils of said second laminate tape lying in contact with the other of said metal foils of said first laminate tape but being unbonded thereto whereby the tubular portion of an electrical connector is insertable between said first and second laminate tapes; and (e) a plastic jacket circumferentially surrounding said second laminate tape.

6. A coaxial cable as in claim 5 wherein a further tape of woven glass strands circumferentially surrounds said second laminate tape, one major surface of said further tape being adhesively bonded to said plastic jacket and the other major surface of said further tape being adhesively bonded to the other of the metal foils of said second laminate tape.

7. A coaxial cable as described in claim 5 wherein said first laminate tape is bonded to said cylindrical core by a copolymer of ethylene and acrylic acid.

8. A coaxial cable as described in claim 6 wherein said further tape is adhesively bonded to said other of said metal foils of said second laminate tape by a copolymer of ethylene and acrylic acid.

9. An electric cable as described in claim 6 wherein said tape of woven glass strands is bonded to the jacket and said second laminate tape by a copolymer of ethylene and acrylic acid.

10. A coaxial cable comprising:

(a) an inner metallic conductor;

(b) a cylindrical core of polyolefin insulation surrounding said conductor;

(c) a first laminate tape composed of two metallic foils adhesively bonded to opposite surfaces of a plastic film, said first laminate tape circumferentially surrounding said cylindrical core, one of said metallic foils of said first laminate tape being adhesively bonded to substantially the entire outermost surface of said cylindrical core;

(d) a second laminate tape circumferentially surrounding said first laminate tape and composed of two metallic foils adhesively bonded to opposite surfaces of a plastic film, one of the metallic foils of said second laminate tape lying in contact with the other of said metallic foils of said first laminate tape but being unbonded thereto whereby the tubular portion of an electrical connector is insertable between said first and second laminate tapes; and (e) electrically non-conductive means circumferentially surrounding and covering said second laminate tape and adhesively bonded to the other of the metallic foils of said second laminate tape.

11. The coaxial cable defined in claim 10 wherein said electrically non-conductive means forms a tube and wherein a plastic jacket circumferentially surrounds and is adhesively bonded to said electrically non-conductive means.

12. The coaxial cable defined in claim 10 wherein said electrically non-conductive means comprises a non-conductive tape formed independently of said first and second laminate tapes and wrapped around said second laminate tape.

13. The coaxial cable defined in claim 12 comprising a plastic jacket circumferentially surrounding and adhesively bonded to said non-conductive tape.

* * * * *

UNITED STATES PATENT OFFICE

CERTIFICATE OF CORRECTION

Patent No. 4,117,260 Dated September 26, 1978

Inventor(s) Frederic Nash Wilkenloh

It is certified that error appears in the above-identified patent and that said Letters Patent are hereby corrected as shown below:

Under [73] on the data sheet of the patent the Assignee and its location is incorrectly stated. It should read--Comm/Scope Company, Catawba, North Carolina--rather than ComulScope Company, Catawba, N. J.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*

Disclaimer 4,117,260.—*Frederic Nash Wilkenloh*, Conover, N.C. COAXIAL DROP WIRE. Patent dated Sept. 26, 1978. Disclaimer filed Mar. 17, 1980, by the assignee, *Comm/Scope Company*.

Hereby enters this disclaimer to the entire remaining term of said patent.

[*Official Gazette, May 13, 1980.*]